US009466920B2

(12) United States Patent
Wu et al.

(10) Patent No.: US 9,466,920 B2
(45) Date of Patent: Oct. 11, 2016

(54) MAGNETIC CONNECTOR FOR ELECTRONIC DEVICE

(71) Applicant: FOXCONN INTERCONNECT TECHNOLOGY LIMITED, Grand Cayman (KY)

(72) Inventors: Jerry Wu, Irvine, CA (US); Qing-Man Zhu, Kunshan (CN); Jian-Jun Zhu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/578,827

(22) Filed: Dec. 22, 2014

(65) Prior Publication Data

US 2015/0188254 A1 Jul. 2, 2015

(30) Foreign Application Priority Data

Dec. 30, 2013 (CN) ..... 2013 1 0741428
Dec. 30, 2013 (CN) ..... 2013 1 0741489
Dec. 30, 2013 (CN) ..... 2013 1 0742050
Dec. 30, 2013 (CN) ..... 2013 2 0879118 U

(51) Int. Cl.

*H01R 13/60* (2006.01)
*H01R 13/62* (2006.01)
*H01R 13/24* (2006.01)
*H01R 24/62* (2011.01)

(52) U.S. Cl.

CPC ..... *H01R 13/6205* (2013.01); *H01R 13/24* (2013.01); *H01R 24/62* (2013.01)

(58) Field of Classification Search

CPC ..... H01R 13/6205; H01R 13/64; H01R 13/2421; H01R 11/30; H01R 31/06
USPC ..... 439/39
See application file for complete search history.

(56) References Cited

U.S. PATENT DOCUMENTS 2,170,287 A * 8/1939 Kinnebrew ..... H01R 13/6205 439/180
3,363,214 A * 1/1968 Wright ..... H01R 13/6205 439/180
3,786,391 A * 1/1974 Mathauser ..... H01R 13/6205 335/205
5,233,295 A * 8/1993 Murata ..... G01B 7/06 123/146.5 A
5,954,520 A * 9/1999 Schmidt ..... B60D 1/64 439/289
7,351,066 B2 4/2008 DiFonzo et al.
7,445,452 B1 * 11/2008 Wu ..... H01R 13/6205 439/39
7,497,693 B1 * 3/2009 Wu ..... H01R 13/2442 439/39

(Continued)

FOREIGN PATENT DOCUMENTS

CN 2850038 Y 12/2006
CN 201191680 Y 2/2009

(Continued)

*Primary Examiner* — Abdullah Riyami
*Assistant Examiner* — Vladimir Imas
(74) *Attorney, Agent, or Firm* — Ming Chieh Chang; Wei Te Chung

(57) ABSTRACT

A magnetic connector including: a flat engaging surface; a number of electrical contacts each having a flexible mating portion protruding to the engaging surface; an insulative housing comprising plural contact channels for receiving the electrical contacts and a first fixing space communicating with the contact channels; and a first magnet assembled to the first fixing space along a direction parallel to the flat engaging surface, the first magnet overhanging over the electrical contacts.

20 Claims, 7 Drawing Sheets

(56) References Cited

U.S. PATENT DOCUMENTS

| | | | | |
|---|---|---|---|---|
| 7,658,613 | B1 * | 2/2010 | Griffin | H01R 13/6205 439/39 |
| 7,762,817 | B2 * | 7/2010 | Ligtenberg | H01R 13/74 439/38 |
| 7,775,801 | B2 * | 8/2010 | Shiff | H01R 13/6205 439/39 |
| 7,963,773 | B2 * | 6/2011 | Palli | H01R 13/6205 439/38 |
| 8,388,353 | B2 * | 3/2013 | Kiani | H01R 13/7037 439/39 |
| 8,388,354 | B1 * | 3/2013 | Lin | H01R 13/6205 439/39 |
| 8,398,409 | B2 * | 3/2013 | Schmidt | H01R 11/30 439/39 |
| 8,449,304 | B1 * | 5/2013 | Lin | H01R 13/645 439/39 |
| 8,460,007 | B1 | 6/2013 | Xie et al. | |
| 8,460,008 | B1 * | 6/2013 | Lin | H01R 13/2421 439/39 |
| 8,523,577 | B1 * | 9/2013 | Huang | H01R 13/6205 439/39 |
| 8,790,120 | B2 | 7/2014 | Wang et al. | |
| 8,851,912 | B2 * | 10/2014 | Zhang | H01R 13/6205 439/159 |
| 9,065,205 | B2 * | 6/2015 | Gao | H01R 13/508 |
| 9,099,806 | B2 * | 8/2015 | Wang | H01R 13/6205 |
| 9,172,178 | B2 * | 10/2015 | Isenhour | H01R 13/6205 |
| 2002/0048982 | A1 * | 4/2002 | Gu | H01R 13/6315 439/247 |
| 2004/0184295 | A1 * | 9/2004 | Robertson | H01R 13/7036 363/146 |
| 2007/0072443 | A1 * | 3/2007 | Rohrbach | H01R 13/6205 439/39 |
| 2015/0349457 | A1 | 12/2015 | Shariff et al. | |

FOREIGN PATENT DOCUMENTS

| | | | |
|---|---|---|---|
| CN | 101515685 | A | 8/2009 |
| CN | 202004263 | U | 10/2011 |
| CN | 101273499 | B | 5/2012 |
| CN | 203014056 | U | 6/2013 |
| CN | 203180215 | U | 9/2013 |
| CN | 203192986 | U | 9/2013 |

* cited by examiner

MAGNETIC CONNECTOR FOR ELECTRONIC DEVICE

BACKGROUND OF THE INVENTION

1. Field of the Invention

The present invention generally relates to a magnetic connector, and more particularly relates to the magnetic connector for connecting an electronic device.

2. Description of Related Art

U.S. Pat. No. 8,790,120 issued on Jul. 29, 2014 discloses a plug connector suitable for connecting a receptacle of a portable electronic device. The plug connector comprises a body, a plug, a sliding base, and at least one magnetic component fixed to the sliding base. The receptacle comprises at least one magnetic element, and a location of the magnetic element of the receptacle corresponds to a location of the magnetic component of the plug connector. Therefore, the magnetic component on the plug connector and the magnetic element on the portable electronic device are magnetically attracted. The design aims at that the plug is easily aligned to the receptacle of the portable electronic device so as to obviate the problem of scratching the casing of the portable electronic device at an improper mating angle and damages to the receptacle.

U.S. Pat. No. 7,351,066 issued on Apr. 1, 2008 discloses a related art. According to the disclosure, a magnetic connector comprises a housing defining a plurality of contact channels and plural receiving spaces, a plurality of electrical contacts disposed on the corresponding contact channels, and plural magnets mounted on the receiving spaces.

Hence, a magnetic connector having an improved magnets installation is desired.

SUMMARY OF THE INVENTION

Accordingly, an object of the present invention is to provide a magnetic connector having stable connection with a complementary connector.

In order to achieve the above-mentioned object, a magnetic connector comprises: a flat engaging surface; a plurality of electrical contacts each having a flexible mating portion protruding to the engaging surface; an insulative housing comprising plural contact channels for receiving the electrical contacts and a first fixing space communicating with the contact channels; and a first magnet assembled to the first fixing space along a direction parallel to the engaging surface, the first magnet overhanging over the electrical contacts.

Other objects, advantages and novel features of the invention will become more apparent from the following detailed description when taken in conjunction with the accompanying drawings.

DETAILED DESCRIPTION OF THE PREFERRED EMBODIMENT

Figure 1:
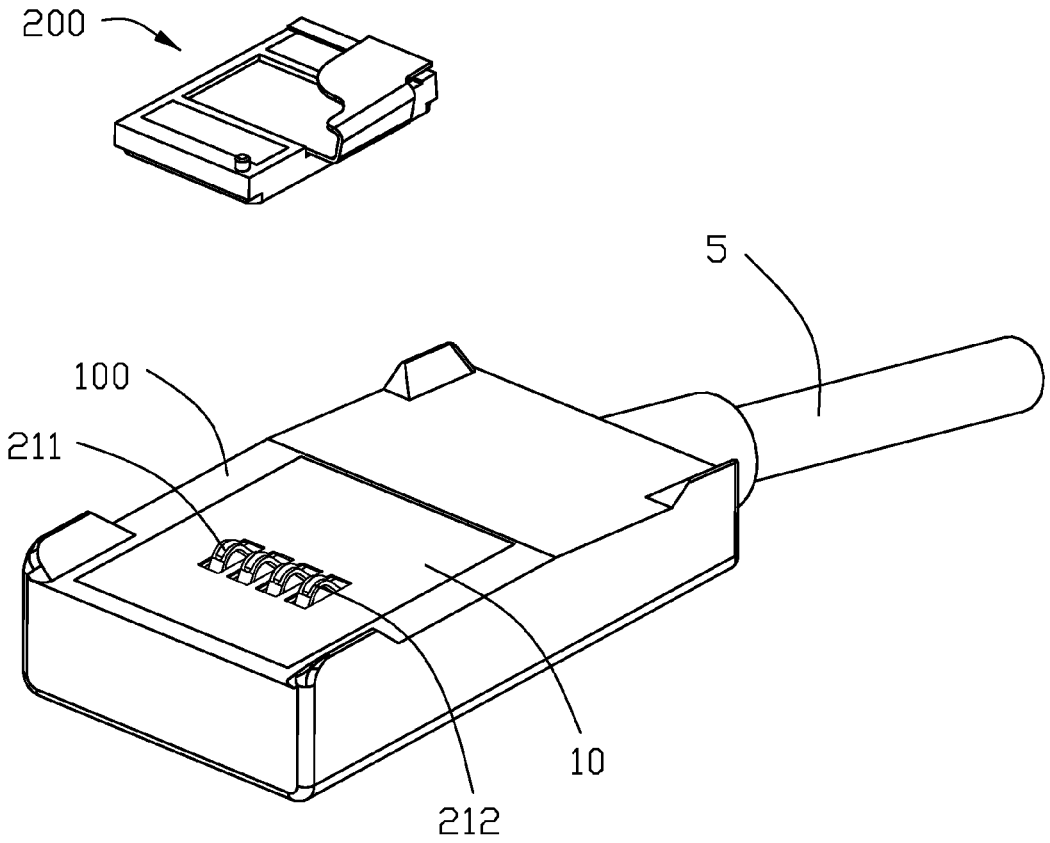
FIG. 1 is a perspective view showing a magnetic connector and a complementary connector in accordance with the present invention.

Reference will now be made to the drawing figures to describe the present invention in detail.

Figure 2:
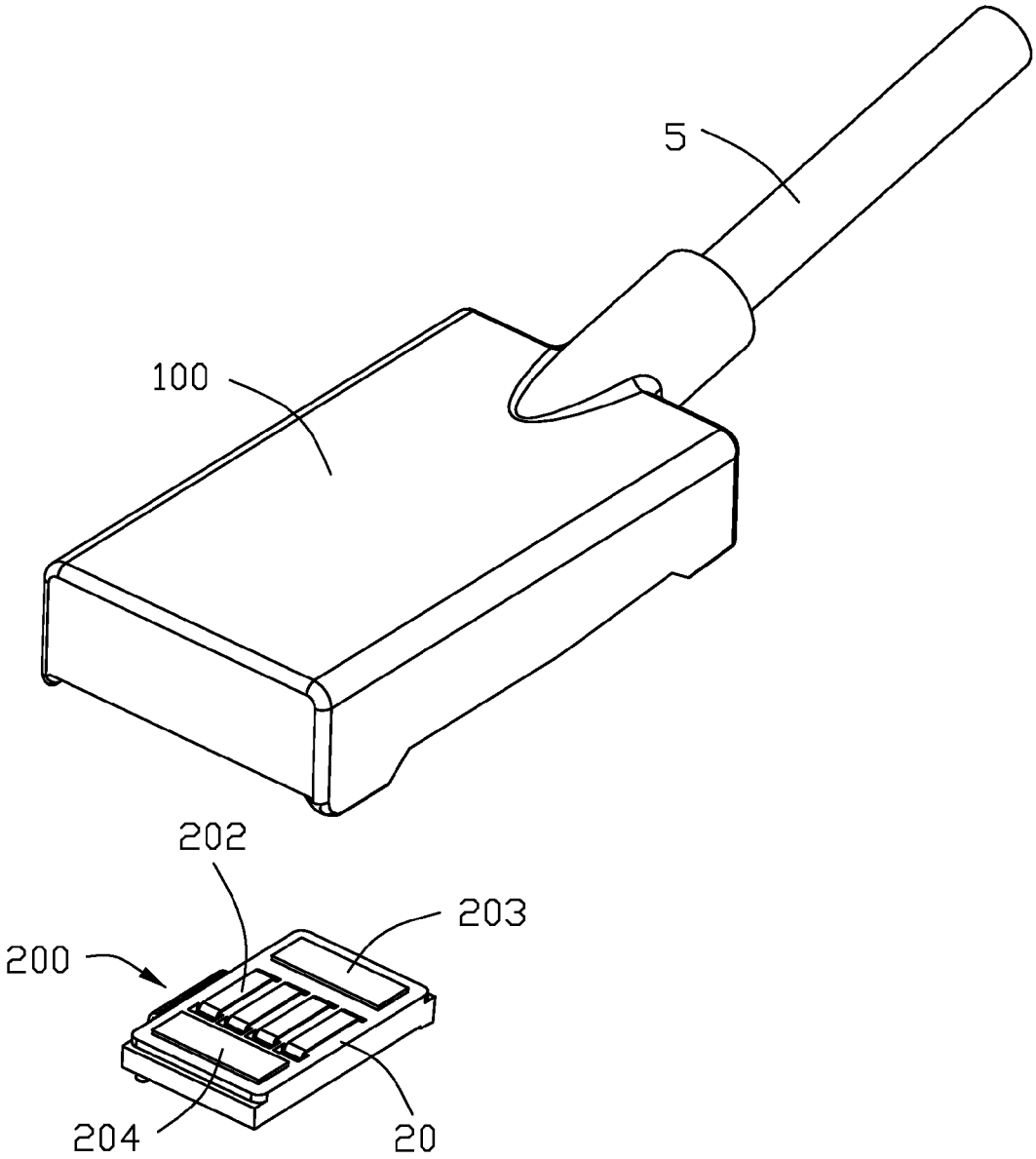
FIG. 2 is another perspective view of the magnetic connector and the complementary connector as shown in FIG. 1.
Figure 3:
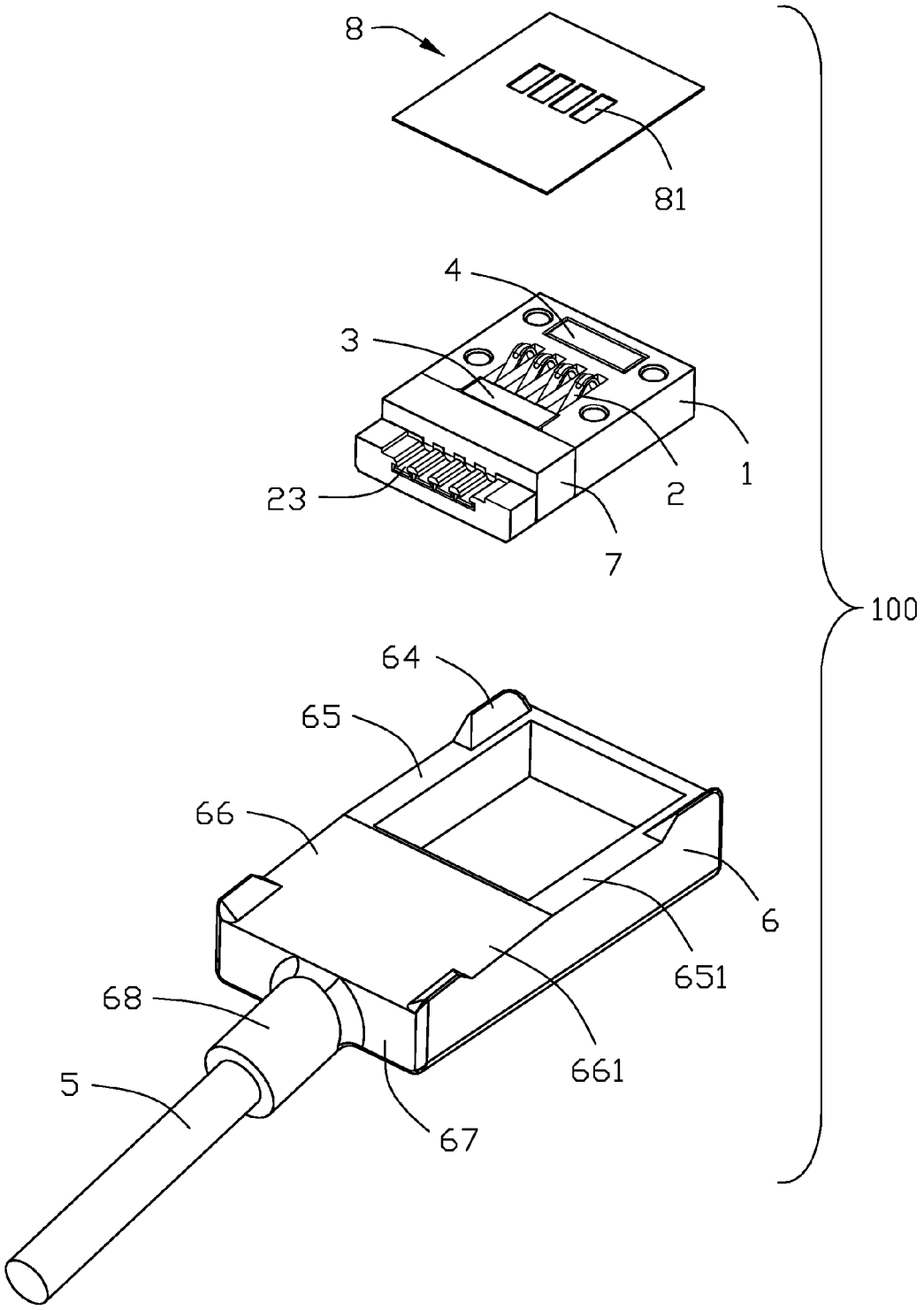
FIG. 3 is partially exploded view of the magnetic connector as shown in FIG. 1.
Figure 4:
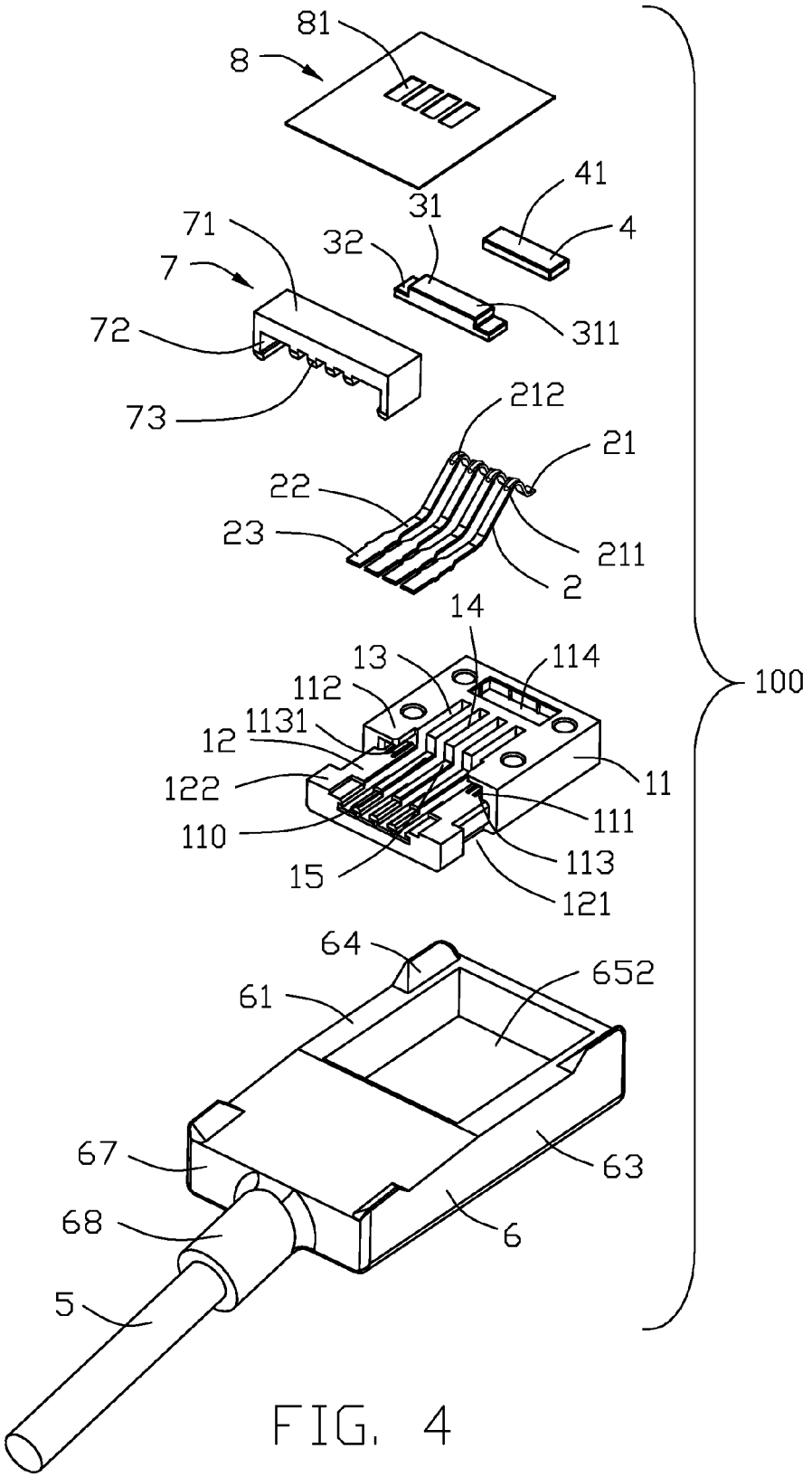
FIG. 4 is an exploded view of the magnetic connector as shown in FIG. 1.
Figure 5:
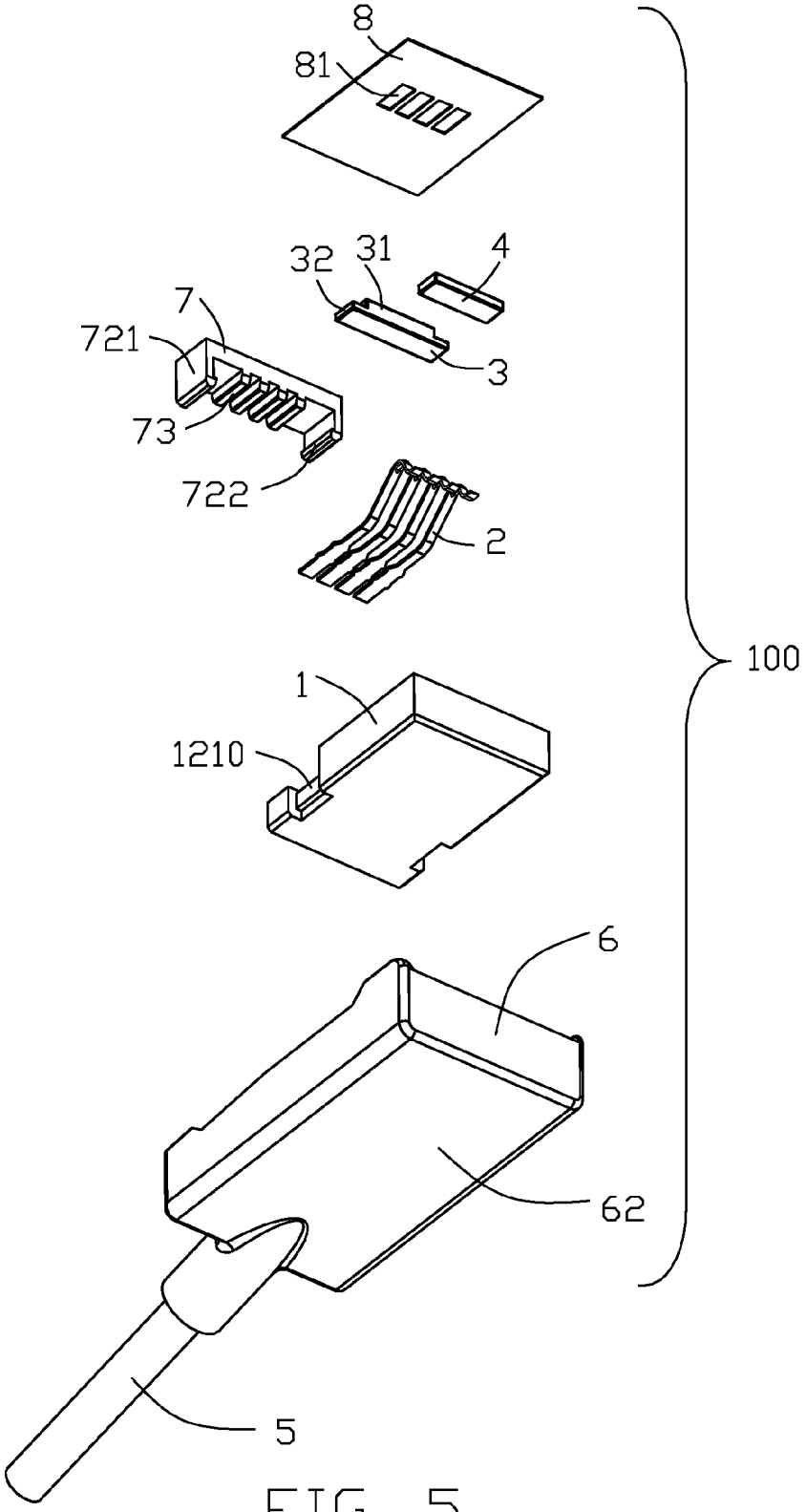
FIG. 5 is similar to FIG. 4, but taken from another view.
Figure 6:
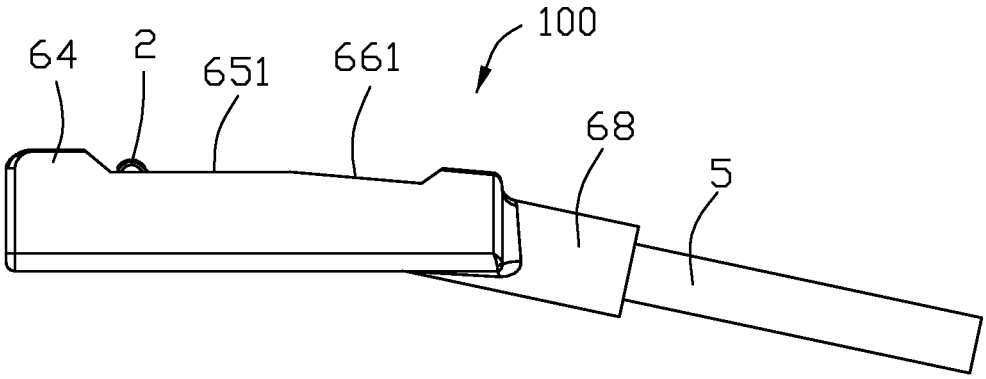
FIG. 6 is a side view of the magnetic connector as shown in FIG. 1.
Figure 7:
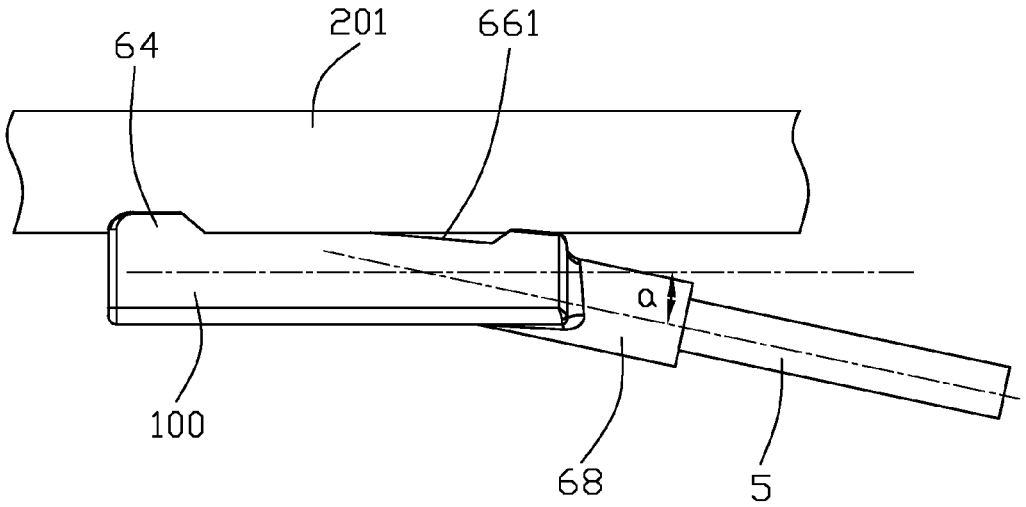
FIG. 7 is a side view of the magnetic connector mated with a frame of an electronic device.

Referring to FIGS. 1 to 7, there is shown a magnetic connector 100 being mated with a complementary connector 200 positioned on a frame of an electronic device (not shown) used for transmitting power signal or transmitting a signal in accordance with USB 2.0 transmission protocol. The magnetic connector 100 and the complementary connector 200 can rely on magnetic force from at least one magnet to maintain contact. The magnetic connector 100 comprises a flat engaging surface 10 mated with a mating surface 20 of the complementary connector 200, an insulative housing 1 assembled with a plurality of electrical contacts 2, a first and a second magnets 3, 4 disposed on the insulative housing 1, a cable 5 electrically connected with the electrical contacts 2, a holding element 7 resisted to the first magnet 3 for preventing the first magnet 3 from exiting backwardly, and a cover 6 disposed outside of the insulative housing 1.

The insulative housing 1 comprises a base portion 11 defining a plurality of contact channels 13, an extending portion 12 extending from the base portion 11. A size of the base portion 11 is larger than a size of the extending portion 12 in a mating direction of the magnetic connector 100. A first fixing space 110 is disposed on a rear end of the base portion 11. The first magnet 3 is inserted into and received in the first fixing space 110 along a direction parallel to the engaging surface 10. A pair of resisting portions 111 are located on left and right sides of the base portion 11 respectively, and each resisting portion 111 is adjacent to the first fixing space 110. A pair of connecting portions 112 are connected with the corresponding resisting portions 111 respectively, and each connecting portion 112 is disposed adjacent to the first fixing space 110. An L-shaped recess 113 is surrounded by the resisting portion 111 and the corresponding connecting portion 112. A plurality of ribs 1131 are disposed on the recess 113 for interference fitting with the first magnet 3 to enhance a fixing force between the first magnet 3 and the first fixing space 110. The extending portion 12 comprises a pair of slots 121 inwardly recessed on left and right sides of the extending portion 112 respectively, a pair of lugs 1210 projecting from the corresponding slots 121 respectively, and a pair of flanges 122 extending outwardly horizontally from two sides of a rear end of the extending portion 12. The contact channels 13 extends rearwardly from the base portion 11 and runs through the extending portion 12 to receive electrical contacts 2. The first fixing space 110 and the contact channels 13 are in fluid communication with each other. The insulative housing 1 further comprises plural platforms 14 each formed between adjacent contact channels 13 to space apart from each electrical contact 2. A depressed portion 15 is formed at a rear end of the corresponding platform 14.

Each electrical contact 2 comprises a flexible mating portion 21 electrically connected with a corresponding mating contact 202 of the complementary connector 200, a retaining portion 22 extending bent from the flexible mating portion 21, and a tail portion 23 connected with the retaining portion 22. The flexible mating portion 21 includes a bending portion 211 designed into arc-shaped and a ridge portion 212 bulged from the bending portion 211 to electrically connected with the corresponding mating contact 202 of the complementary connector 200. In the prior art, if debris are attached to the flexible mating portion 21 of the electrical contact 2, electrical connection between the flexible mating portion 21 and the complementary connector 200 will be affected. However, the ridge portion 212 can ensure stable electrical connection between the magnetic connector 100 and the complementary connector 200. The tail portions 23 of the electrical contacts 2 are connected with the cable 5 by soldering. The flexible mating portion 21 and the tail portion 23 are disposed at front and rear ends of the first magnet 3. The first magnet 3 and the retaining portions 22 of the electrical contacts 2 are partly overlapping along the mating direction of the magnetic connector 100, i.e., the first magnet overhanging over the electrical contacts. The magnetic connector 100 comprises a body (not shown) enclosing a soldering area between the electrical contacts 2 and the cable 5 to protect solder joints.

The first magnet 3 comprises a body portion 31, a stepped portion 32 received in the recess 113 and extending outwardly from two sides of the body portion 31. A thickness of the body portion 31 is larger than a thickness of the stepped portion 32 in the mating direction. The body portion 31 of the first magnet 3 comprises a first surface 311 flushed with the engaging surface 10 of the magnetic connector 100. The pair of resisting portions 111 resist against the left and right sides of the stepped portion 32. And the connecting portion 112 resists against an upside of the stepped portion 32. In this embodiment, due to the contact channel 13 and the first fixing space 110 communicating with each other, the first magnet 3 is connected with the first fixing space 110 by assembling along a back-to-front direction.

The holding element 7 comprises a beam portion 71, a pair of posts 72 extending downwardly from two sides of the beam portion 71 and plural engaging portions 73 spaced apart from each other. A height of the engaging portion 73 projecting downwardly is not larger than a height of the post 72 extending downwardly. A width of the engaging portion 73 is not larger than a width of the contact channel 13 in the mating direction of the magnetic connector 100. When the holding element 7 is mounted on the insulative housing 1, each engaging portion 73 will be received in the corresponding contact channel 13. The post 72 comprises a vertical portion 721 and a hook portion 722 inwardly projecting from the vertical portion 721. Each lug 1210 is engaged with the corresponding hook portion 722 of the post 72 to prevent the holding element 7 from exiting the insulative housing 1 along an upper direction. The flange 122 resists against a rear end of the post 72 to prevent the holding element 7 from exiting rearwardly.

The second magnet 4 is designed into a rectangular shape and comprising a second surface 41 in flush with the engaging surface 10. A second fixing space 114 is disposed on the base portion 11 to receive the second magnet 4. On one hand, the second magnet 4 can be connected with the fixing space 114 by assembling, and on the other hand, a distance between the second magnet 4 and the electrical contacts is far, and the second fixing space 114 is not communicated with the contact channel 13. Therefore, the glue can be used to connect the second magnet 4 with the second fixing space 114. The first magnet 3 and the second magnet 4 are disposed at the front and rear ends of the flexible mating portion 21, respectively. This not only can ensure the balance of the whole structure by designing two magnets 3, 4, but also enhance the magnetic force between the magnetic connector 100 and the complementary connector 200. The complementary connector 200 comprises a first magnetic element 203 and a second magnetic element 204 engaged with the first magnet 3 and the second magnet 4, respectively. Each of the first and the second magnetic elements 203, 204 can be a magnet or ferromagnetic material. The first and the second magnets 3, 4 have a same polarity. The first and the second magnetic element 203, 204 have a same polarity. But the polarities of the first and the second magnets 3, 4 are different from the polarities of the first and the second magnetic elements 203, 204 for making the magnetic connector 100 magnetic attraction with the complementary connector 200.

The cover 6 is integrally molded with the insulative housing 1 and forms a receiving space 652. The cover 6 can be connected with the insulative housing 1 by other suitable means. The cover 6 comprises a top wall 61, a bottom wall 62, a pair of side walls 63 connected with the top wall 61 and the bottom wall 62, and a plurality of arm portions 64 projecting outwardly from the top wall 61 along the mating direction of the magnetic connector 100. In this embodiment, the plurality of arm portions 64 comprises a pair of arm portions 64 disposed on two sides of a front end of the cover 6 respectively, and a pair of arm portions 64 are disposed on two sides of a rear end of the cover 6, respectively. It is helpful to increase the connection stability between the magnetic connector 100 and the complementary connector 200. The cover 6 comprises a front portion 65 defining a front surface 651 and a rear portion 66 connecting with the front portion 65. The front portion 65 is used to contact with the electronic device (not shown). The rear portion 66 defines a rear surface 661 located on a same side with the front surface 651, and a rear wall 67 for the cable to pass through. The rear surface 661 is located on a different horizontal plane from the front surface 651. Therefore, a first angle can be formed between the rear surface 661 and the front surface 651. Other structures can be formed between the rear surface 661 and the front surface 651, such as a step, as long as a distance between the rear surface 661 and the mating surface 20 is larger than a distance between the front surface 651 and the mating surface 20. And a gap will be formed between the rear portion 66 of the magnetic connector 100 and the frame of the electronic device, when the magnetic connector 100 is connected with the complementary connector 200. In the prior art, if debris or small particles are attached to the frame of the electronic device, the magnetic connector 100 will be uplifted outwardly, which affects an electrical connection between the magnetic connector 100 and the complementary connector 200. However, the gap will be used to obviate such problem.

A sleeve 68 is integrally molded on the rear portion of the cover 6 for the cable passing through. The sleeve 68 extends along an incline direction which the sleeve 68 far away from the complementary connector 200. A distance between the sleeve 68 and the mating surface 20 is larger than a distance between the engaging surface 10 and the mating surface 20 in the mating direction of the magnetic connector 100. The rear wall 67 of the cover 6 is vertical to the mating surface 20 of the complementary connector 200. A second angle is formed between the cable 5 and the engaging surface 10. In this embodiment, the second angle is 12 degrees. It is convenient for operators to hold.

The magnetic connector 100 further comprises a slice 8 attached to the insulative housing 1. In this embodiment, the slice 8 is made of PET material and comprises plural openings 81 for electrical contacts 2 to penetrate. The engaging surface 10 of the magnetic connector 100 is a surface of the slice 8. In other embodiment, the magnetic connector 100 may not be disposed the slice 8. In such embodiment, the engaging surface 10 of the magnetic connector 100 will be a surface of the insulative housing 1.

In assembling of the magnetic connector 100, the electrical contacts 2 are first inserted in the corresponding contact channels 13 respectively in a rear-to-front direction. The first magnet 3 is inserted and received into the first fixing space 110. Then the holding element 7 is mounted on the insulative housing 1 and resists against the first magnet 3. Next, the cable 5 is connected with the electrical contacts by soldering. And, the soldering area between the electrical contacts 2 and the cable 5 is enclosed. The cover 6 is over-molded with the insulative housing 1 and the front end of the cable 5. The second magnet 4 is mounted on the second fixing space 114. Finally, the slice 8 is attached to the insulative housing 1. It is noted that a force direction of the electrical contacts 2 from the complementary connector 200 in the mating direction and a magnetic force direction of the first and second magnets 3, 4 from the complementary connector 200 are reverse.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A magnetic connector comprising:

a flat engaging surface;

a plurality of electrical contacts each having a flexible mating portion protruding to the engaging surface;

an insulative housing comprising plural contact channels for receiving the electrical contacts and a first fixing space communicating with the contact channels; and a first magnet assembled to the first fixing space along a direction parallel to the engaging surface, the first magnet overhanging over the electrical contacts;

wherein each of the electrical contacts comprises a retaining portion extending bent from the flexible mating portion and a tail portion, the flexible mating portion and the tail portion disposed at front and rear ends of the first magnet, respectively.

2. The magnetic connector as claimed in claim 1, wherein the first magnet comprises a first surface in flush with the flat engaging surface.

3. The magnetic connector as claimed in claim 1, furthering comprising a holding element assembled to the insulative housing and resisting against the first magnet forwardly.

4. The magnetic connector as claimed in claim 3, wherein the holding element comprises a beam portion and a pair of posts extending downwardly from two sides of the beam portion, and the insulative housing comprises a pair of slots engaged with the corresponding posts.

5. The magnetic connector as claimed in claim 4, wherein each post comprises a vertical portion and a hook portion inwardly projecting from the vertical portion, each slot comprising a lug for limiting the corresponding hook portion.

6. The magnetic connector as claimed in claim 1, further comprising a cover disposed outside of the insulative housing, the cover comprising a front portion having a front surface and a rear portion connecting with the front portion, the rear portion comprising a rear surface located on a same side with the front surface, the front surface and the rear surface being in different horizontal planes.

7. The magnetic connector as claimed in claim 6, wherein the cover comprises a top wall, a bottom wall opposite to the top wall, and a pair of side walls connected with the top wall and the bottom wall, the cover further comprising a plurality of arm portions projecting from the top wall.

8. The magnetic connector as claimed in claim 1, further comprising a cable electrically connected with the electrical contacts, an angle being defined between an extending direction of the cable and the engaging surface.

9. The magnetic connector as claimed in claim 1, further comprising a slice attached to the insulative housing, the slice having plural openings for extending the electrical contacts.

10. A magnetic connector comprising:

a flat engaging surface;

a plurality of electrical contacts each having a flexible mating portion protruding to the engaging surface;

an insulative housing comprising plural contact channels for receiving the electrical contacts and a first fixing space communicating with the contact channels; and a first magnet assembled to the first fixing space along a direction parallel to the engaging surface, the first magnet overhanging over the electrical contacts; and a second magnet, and wherein the insulative housing comprises a second fixing space receiving the second magnet, the second magnet comprising a second surface in flush with the engaging surface.

11. The magnetic connector as claimed in claim 10, wherein the first magnet and the second magnet are disposed at front and rear ends of the flexible mating portion, respectively.

12. The magnetic connector as claimed in claim 10, wherein the first magnet and the second magnet have a same polarity.

13. The magnetic connector as claimed in claim 10, further including a holding element assembled to the insulative housing and resisting against the magnet forwardly.

14. A magnetic connector comprising:

an insulative housing defining a plurality of contact channels extending along a front-to-back direction and communicating with an exterior upwardly in a vertical direction perpendicular to said front-to-back direction;

a plurality of contacts disposed in the corresponding contact channels, respectively, each of said contacts having a flexible mating portion upwardly extending in the vertical direction above an engaging surface on the housing;

a fixing space formed in the housing and below the engaging surface; and a magnet disposed within the fixing space; wherein said fixing space is configured with restriction structures to prohibit the magnet from moving upwardly or downward in the vertical direction and allow the magnet to be loaded/unloaded only in the front-to-back direction while the magnet functions in said vertical direction.

15. The magnetic connector as claimed in claim 14, wherein said magnet forms a corresponding structure coupled to said restriction structure.

16. The magnetic connector as claimed in claim 15, wherein each of said restriction structure and said corresponding structure forms a step.

17. The magnetic connector as claimed in claim 14, wherein the magnet comprises a body portion and a stepped portion extending outwardly from two sides of the body portion, and a thickness of the body portion being larger than a thickness of the stepped portion, and the insulative housing comprises a base portion defining an L-shaped recess receiving the stepped portion and an extending portion extending rearwardly from the base portion.

18. The magnetic connector as claimed in claim 17, wherein the insulative housing comprises a pair of resisting portions on two sides of the base portion adjacent to the first fixing space, and a respective connecting portion continuing an associated resisting portion and adjacent to the first fixing space, the recess being defined by the resisting portion and the associated connecting portion.

19. The magnetic connector as claimed in claim 14, further including a holding element assembled to the insulative housing in the vertical direction and resisting against the magnet in the front-to-back direction.

20. The magnetic connector as claimed in claim 14, wherein the contacts are connected to a cable behind the housing in the front-to-back direction.

* * * * *